US009597563B2

(12) United States Patent
Voshall et al.

(10) Patent No.: US 9,597,563 B2
(45) Date of Patent: Mar. 21, 2017

(54) MULTI-TRACK ADJUSTABLE GOLF CLUB

(71) Applicant: Mizuno USA, Inc., Norcross, GA (US)

(72) Inventors: Chris Voshall, Atlanta, GA (US); David Llewellyn, Duluth, GA (US); Kazuya Ishida, Osaka (JP); Tetsuya Kanayama, Osaka (JP); Kei Tsuji, Osaka (JP)

(73) Assignee: Mizuno USA, Inc., Norcross, GA (US)

( * ) Notice: Subject to any disclaimer, the term of this patent is extended or adjusted under 35 U.S.C. 154(b) by 0 days.

(21) Appl. No.: 14/309,472

(22) Filed: Jun. 19, 2014

(65) Prior Publication Data

US 2015/0297961 A1 Oct. 22, 2015

Related U.S. Application Data

(60) Provisional application No. 61/982,264, filed on Apr. 21, 2014.

(51) Int. Cl.

| | |
|---|---|
| ***A63B 69/36*** | (2006.01) |
| ***A63B 53/06*** | (2015.01) |
| ***A63B 53/04*** | (2015.01) |

(52) U.S. Cl.

CPC ..... *A63B 53/06* (2013.01); *A63B 53/0466* (2013.01); *A63B 2053/0433* (2013.01); *A63B 2053/0491* (2013.01)

(58) Field of Classification Search

CPC .... A63B 2053/0491; A63B 2053/0495; A63B 53/06; A63B 53/0466; A63B 2053/0433

USPC ..... 473/324–350, 287–292

See application file for complete search history.

(56) References Cited

U.S. PATENT DOCUMENTS

| | | | | | |
|---|---|---|---|---|---|
| 1,322,182 | A | * | 11/1919 | Duncan | A63B 53/04 473/344 |
| 1,355,889 | A | * | 10/1920 | Campbell | A63B 53/08 473/342 |
| 2,155,830 | A | | 4/1939 | Howard | |
| 3,680,868 | A | * | 8/1972 | Jacob | A63B 53/0487 473/230 |

(Continued)

FOREIGN PATENT DOCUMENTS

| | | | |
|---|---|---|---|
| JP | H07163685 | A | 6/1995 |
| JP | 2006320493 | A | 11/2006 |

(Continued)

OTHER PUBLICATIONS

Extended European Search Report in related EP Application No. 15164335.0, mailed Aug. 12, 2015.

(Continued)

*Primary Examiner* — Sebastiano Passaniti

(74) *Attorney, Agent, or Firm* — Troutman Sanders, LLP; James E. Schutz; Daniel T. Sharpe

(57) ABSTRACT

An adjustable golf club is disclosed. The adjustable golf club can include a club head having a sole. The sole of the club head may have two or more tracks located thereon. Each track can be configured to receive at least one weight. The two or more tracks may be three tracks. The three tracks can comprise an elongated central track, a first short track disposed on a first side of the elongated central track, and a second short track disposed on the second side of the elongated central track.

13 Claims, 4 Drawing Sheets

(56) References Cited

U.S. PATENT DOCUMENTS 3,912,277 A * 10/1975 Pelz ..... A63B 53/007 473/236
4,530,505 A * 7/1985 Stuff ..... A63B 69/3685 473/250
5,213,329 A * 5/1993 Okumoto ..... A63B 53/04 473/328
5,230,509 A * 7/1993 Chavez ..... A63B 53/0487 473/334
5,257,786 A * 11/1993 Gorman ..... 473/349
5,720,674 A * 2/1998 Galy ..... A63B 53/04 473/334
5,938,540 A * 8/1999 Lu ..... A63B 53/04 473/288
5,989,134 A * 11/1999 Antonious ..... A63B 53/04 473/327
6,056,649 A * 5/2000 Imai ..... A63B 53/04 473/328
6,123,627 A * 9/2000 Antonious ..... A63B 53/04 473/327
6,277,032 B1 * 8/2001 Smith ..... 473/336
6,991,560 B2 * 1/2006 Tseng ..... A63B 53/0466 473/332
7,166,041 B2 * 1/2007 Evans ..... A63B 53/0466 473/334
7,186,190 B1 * 3/2007 Beach et al. ..... 473/335
7,572,193 B2 * 8/2009 Yokota ..... 473/328
7,611,424 B2 * 11/2009 Nagai et al. ..... 473/334
7,806,782 B2 * 10/2010 Stites et al. ..... 473/334
7,824,280 B2 * 11/2010 Yokota ..... 473/334
8,016,694 B2 * 9/2011 Llewellyn et al. ..... 473/334
8,057,323 B2 * 11/2011 Liang et al. ..... 473/334
8,444,505 B2 * 5/2013 Beach et al. ..... 473/334
8,696,491 B1 4/2014 Myers
9,238,162 B2 * 1/2016 Breier ..... A63B 53/0466
2006/0105856 A1 * 5/2006 Lo ..... 473/334
2006/0122004 A1 * 6/2006 Chen et al. ..... 473/335
2006/0240903 A1 10/2006 Cardosi
2006/0240908 A1 10/2006 Adams et al.
2007/0178988 A1 * 8/2007 Tavares et al. ..... 473/334
2008/0119303 A1 * 5/2008 Bennett et al. ..... 473/338
2008/0146370 A1 6/2008 Beach et al.
2008/0261715 A1 * 10/2008 Carter ..... 473/291
2011/0070969 A1 * 3/2011 Stevens et al. ..... 473/334
2013/0090185 A1 * 4/2013 Boyd et al. ..... 473/337
2014/0018185 A1 * 1/2014 Mizutani ..... 473/345
2014/0080628 A1 * 3/2014 Sargent et al. ..... 473/336
2014/0248976 A1 * 9/2014 Stokke ..... 473/335

FOREIGN PATENT DOCUMENTS

TW M272559 U 8/2005
WO 2013028889 A1 2/2013

OTHER PUBLICATIONS

EPO Communication pursuant to Article 94(3) EPC in related European Patent Application No. 15164335.0, dated Jul. 29, 2016.

* cited by examiner

MULTI-TRACK ADJUSTABLE GOLF CLUB

CROSS-REFERENCE TO RELATED APPLICATION AND PRIORITY CLAIM

This application claims the benefit, under 35 U.S.C. §119(e), of U.S. Provisional Patent Application No. 61/982,264, filed 21 Apr. 2014, entitled "MULTI-TRACK ADJUSTABLE GOLF CLUB," the entire contents and substance of which is incorporated herein by reference in its entirety as if fully set forth below.

BACKGROUND

1. Field of the Invention

The present invention relates generally to golf clubs, and more particularly to multi-track adjustable golf clubs.

2. Background of Related Art

Golfers have many different swing types. This variety in swing types means that different golfers contact the ball in different ways. Each different swing can impart a different spin and/or flight trajectory to the ball. The ball may "draw" or "fade," for example, based on the type of swing the golfer uses. Similarly, the ball may have a trajectory that varies with the spin rate of the ball following contact. A ball with a higher spin rate may rise more after contact than a ball with a lower spin rate would rise. These different trajectories can be desirable when intended and undesirable when unintended.

Golfers' strokes also can change over time. A golfer who previously contacted the ball such that the ball would rise and draw, for example, may modify his swing or stance so that he contacts the ball such that the ball rises less and fades. If the golfer's club is set up to correct a particular swing, and that swing changes, the club may no longer be suitable for the golfer. Adding the ability to adjust a club allows the club to change with the golfer's swing and provide the desired contact and trajectories.

In addition to a golfer's swing, the physical specifications, or inherent characteristics of the club head may also influence trajectory. In general, for a metal wood head, as the center of gravity ("COG") is located further from the shaft axis the club is more fade biased. Conversely, as the COG is located closer to the shaft axis the head is more draw biased. Similarly, a COG located nearer the face may tend to reduce spin and lower the effects of lift force on the ball thus promoting a lower ball flight. The opposite is true for a COG that more rearward (further from the face).

A golfer may desire more distance on the trajectory of his shots. Since the rules of golf limit the spring like effect from the face, an alternate way of generating more distance is to optimize the ball launch for spin and launch angle. This condition allows the ball to fly further and straighter due to improved aerodynamic performance. Having an improved COG location optimized for each individual golfer can improve the launch conditions of the ball, thus having an adjustable weight/COG metal wood can provide additional distance if the player can easily and intuitively find their appropriate weight setting. Traditional golf clubs have predetermined weighting, which results in a fixed COG location. Thus, the clubs cannot be easily modified to compensate for issues with a golfer's swing, such as, for example, unintended draw or fade.

Some prior attempts to address this problem have involved adjustable weight drivers that make use of weight screws. One of the weakness of such systems is that weight screws are not efficient for weight movement, since swapping positions of a first screw with mass A with another screw with mass B results in a net mass movement of A-B. This inefficiency often requires significant weight to be added and subtracted from a club, which may have undesirable effects on other characteristics of the club's performance.

Other attempts to address this problem include single-track systems. In these systems, the track may follow the skirt of the driver in an attempt to be more efficient than using weight screws for weight displacement, but they still lack the ability to isolate the weight movement in the front/back and toe/heel direction, leading to less intuitive self optimization. Some single-track systems that are parallel to the face and in close proximity to the face have little or no ability to adjust COG depth and are likely very front weighted due to the mass of the track, thus no ability to increase spin and trajectory height by COG adjustment in the front/back direction. Current single-track systems also tend to have closed-ended tracks. Tracks with closed ends, however, do not allow for easy movement of the weights from one track to another if the golfer needs more weight in a given area of the head. Additionally, close ended tracks are more difficult and expensive to produce.

What is needed, therefore, is an adjustable golf club that allows the weight of the golf club head to be independently moved in the heel/toe and front/rear directions. The club should be adjustable in this way so that the spin and fade/draw characteristics can be adjusted independently. Additionally, weights should be able to be engaged with the club head easily and securely. It is to such a golf club that embodiments of the present invention are primarily directed.

BRIEF SUMMARY

Embodiments of the present disclosure relate to an adjustable golf club. In some embodiments, the club can be adjusted by adding weights to tracks located on the sole of the club in predetermined locations. An adjustable golf club according to the present disclosure can have a club head having a sole and a ball-striking face. The sole of the golf club head can include two or more tracks located on the sole such that each track can receive at least one weight.

In some embodiments, the two or more tracks can comprise an elongated central track, a first short track disposed on a first side of the elongated central track, and a second short track disposed on the second side of the elongated central track. In some embodiments, the first and second short tracks can be evenly spaced on either side of the elongated central track. In some embodiments, the two short tracks can be configured to accept a weight in only one position. In some embodiments, the elongated central track can be configured to retain a weight in three locking positions. The weights can be retained in place by a spring loaded detent. In some other embodiments, the elongated central track comprises a first, front position for retaining a weight and a second, rear most position for retaining the weight, wherein the elongated central track is configured to retain the weight in any position between the first position and the second position. In some embodiments, the weights can be retained by a set screw.

In some embodiments, the elongated central track can be substantially parallel to the first and second short tracks. The two or more short tracks can be open at least one end. In some embodiments, the two or more short tracks can comprise two perpendicular tracks. In other embodiments, the two perpendicular tracks can cross on the sole. In some other embodiments, the two perpendicular tracks can comprise one track parallel to and located proximate the ball-striking face. In some other embodiments, the two or more tracks can comprise three parallel tracks.

These and other objects, features, and advantages of the present invention will become more apparent upon reading the following specification in conjunction with the accompanying drawing figures.

DETAILED DESCRIPTION

Embodiments of the present invention relate generally to golf clubs, and more particularly to adjustable golf clubs. In some embodiments, a golf club can be adjusted by moving sliders located proximate the heel of the club head. The sliders can be in communication with the shaft of the club, enabling the sliders to reposition the shaft with respect to the club head, which enables adjustment of the club. In some embodiments, a user can loosen a fastener, reposition the sliders, and tighten the fastener to rigidly lock the club in place. In this manner, the user can adjust the club.

To simplify and clarify explanation, the invention is described herein as an adjustable golf club. One skilled in the art will recognize, however, that the invention is not so limited.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention.

As described above, a general problem with conventional adjustable golf clubs is that the COG of the club head cannot be adjusted in the heel/toe and the front/rear directions independently. This can be due to a single track design, for example, that restricts the club to one COG location for a given location along the track. This can restrict the ability of a golfer to adjust the clubs as necessary. This may restrict the golfer's ability to set the COG location to obtain desired fade, draw, and spin for his or her particular swing type in a straight forward, intuitive manner.

Figure 1:
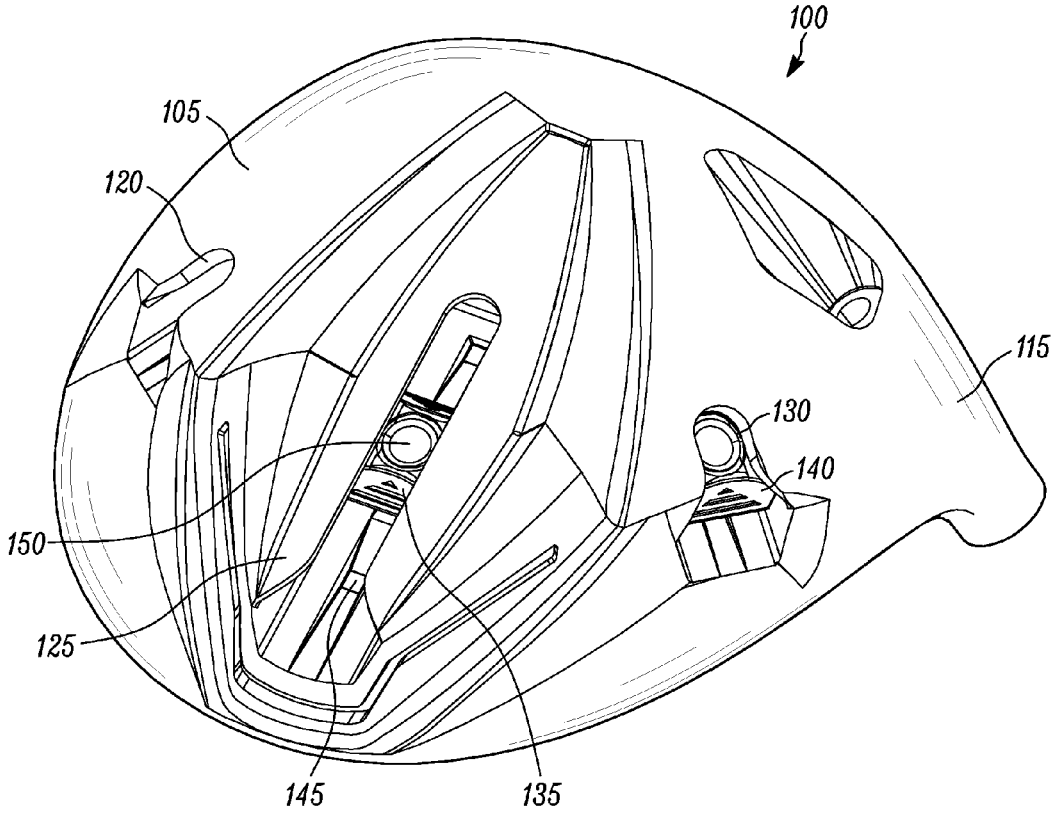
FIG. 1 depicts an adjustable golf club head, in accordance with some embodiments of the present invention.
Figure 2:
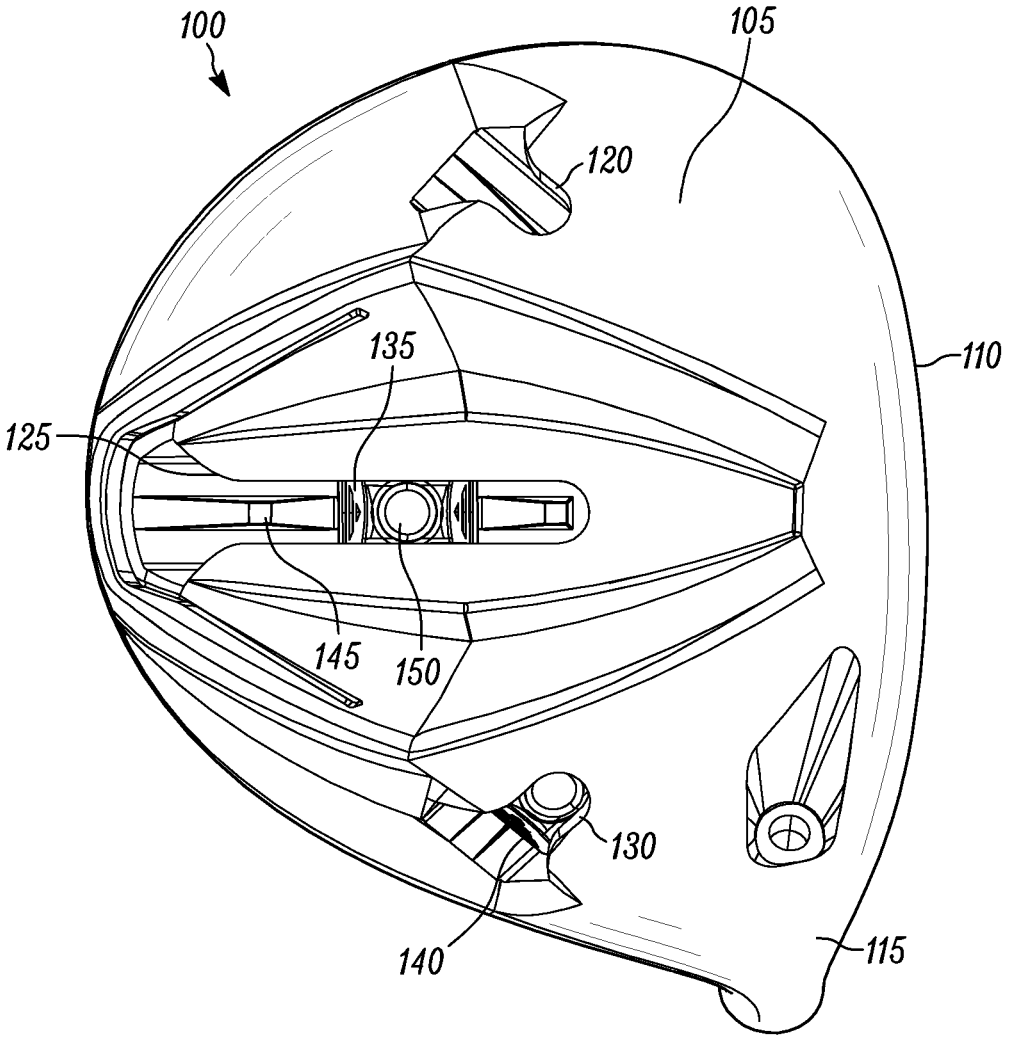
FIG. 2 depicts a bottom view of the adjustable golf club head of FIG. 1.
Figure 3:
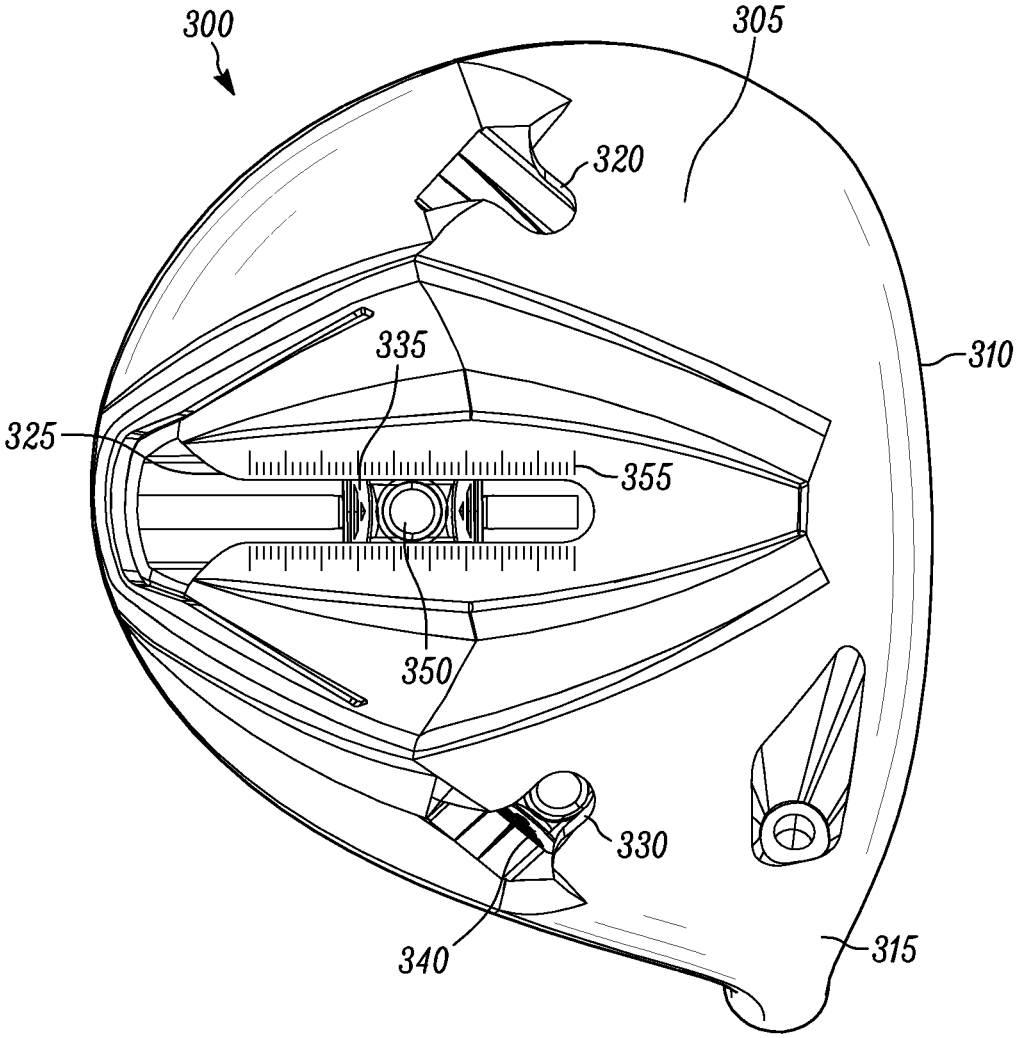
FIG. 3 depicts a bottom view of an adjustable golf club head, in accordance with another embodiment of the present invention.

As shown in FIGS. 1-3, embodiments of the present disclosure can comprise an adjustable golf club. More specifically, embodiments of the present disclosure can comprise an adjustable golf club that enables a user to adjust the COG location in the heel/toe and the front/rear directions independently. The adjustable club can also comprise a means for providing finite or infinite adjustment depending on, for example, the rules of a particular sanctioning body.

In some embodiments, as shown in FIGS. 1 and 2, the adjustable golf club can comprise a golf club head 100. The club head 100 can have a sole 105, a ball striking face 110, and a hosel 115. The sole of head 100 can have two or more tracks 120, 125, 130 for receiving one or more weights 135, 140. The weights 135, 140 can weigh, for example and not limitation, between approximately 3 g and 9 g. In some embodiments, the weights 135, 140 weigh approximately 6 g. In some embodiments, the weights 135, 140 can be of equal weight. In some other embodiments, the weights 135, 140 can be of different weights, for example and not limitation, weight 135 may be 6 g and weight 140 may be 4 g. Of course, other weights can be used and are contemplated herein.

In some embodiments, the track 125 may be an elongated central track, and the tracks 120, 130 can be short tracks. In some embodiments, the elongated central track 125 can include three divots 145 such that the weight 135 can be secured in one of three positions. The weight 135 can engage the divots 145 by making use of a retention mechanism 150. In some embodiments, the retention mechanism 150 can be a spring loaded detent mechanism. In other embodiments, the retention mechanism 150 can be a set screw, or similar locking device as known in the art. The short tracks 120, 130 can be configured to retain a weight in three positions, or fewer positions, such as only one.

As illustrated in FIG. 3, the adjustable golf club head 300 can have a sole 305, a ball striking face 310, and a hosel 315. Similar to the club head 100, the sole of head 300 can have two or more tracks 320, 325, 330 located thereon for receiving one or more weights 335, 340. The track 325 may be an elongated central track, and tracks 320, 330 can be short tracks. The elongated central track 325 can include a front position and a rear position for retaining weight 335, such that the weight 335 can be secured in any position between the front and rear positions. The weight 335 can engage the elongated central track 325 by making use of a retention mechanism 350. In some embodiments, the retention mechanism 350 can be a set screw, or similar locking device as known in the art. Additionally, the club head 300 can have a plurality of markings 355 along the elongated central track 325 in order to allow the position of the weight 335 to be accurately measured and/or adjusted. These markings 355 may take the form of graduations as on a ruler, suggested settings (i.e., based on a series of recommended settings), or some combination thereof.

Figure 6:
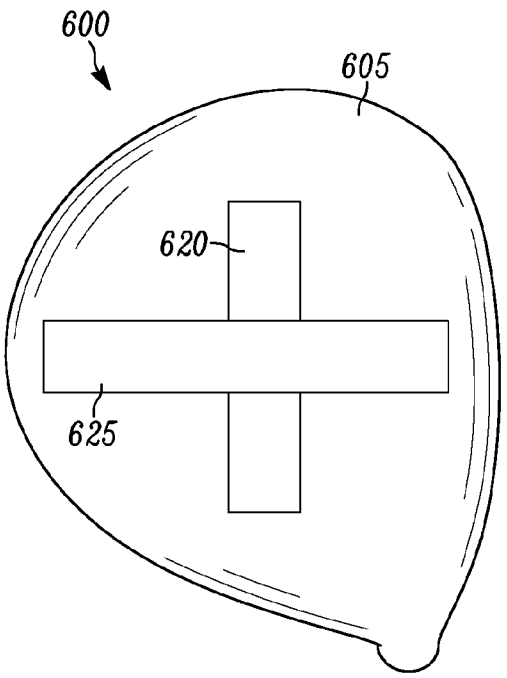
FIG. 6 depicts an adjustable golf club head having two overlapping perpendicular tracks, in accordance with another embodiment of the present invention.
Figure 5:
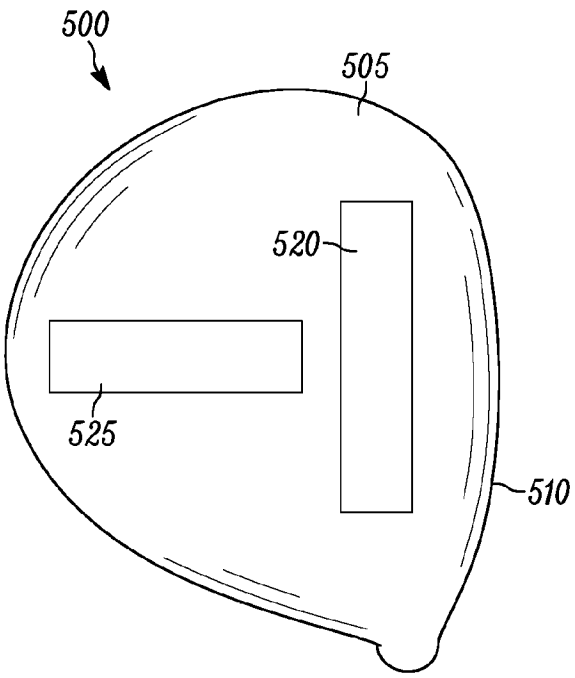
FIG. 5 depicts an adjustable golf club head having two non-overlapping perpendicular tracks, in accordance with another embodiment of the present invention.
Figure 4:
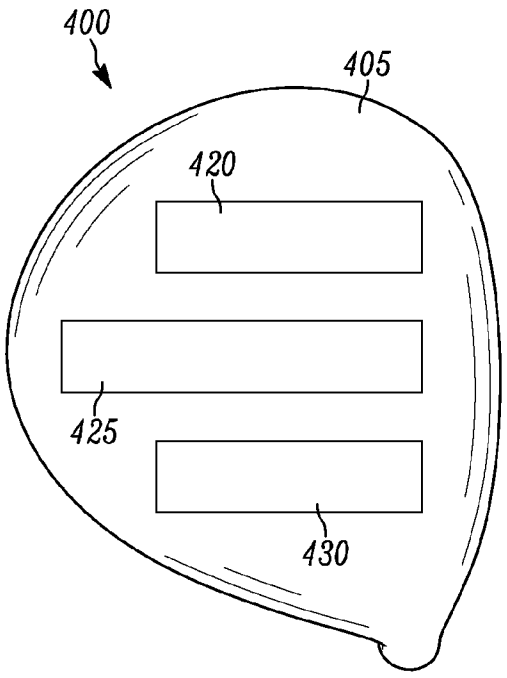
FIG. 4 depicts an adjustable golf club head having three parallel tracks, in accordance with another embodiment of the present invention.

FIGS. 4, 5, and 6 illustrate alternative track arrangements for embodiments according to the present disclosure. In FIG. 4, the adjustable club head 400 is depicted having a sole 405. The club head 400 can have, for example, three parallel tracks 420, 425, 430 located on sole 405. In some embodiments, the tracks 420, 430 may be of substantially equal length, and may be positioned on either side of the track 425. In some embodiments, the track 425 can be substantially equal in length to the tracks 420, 430, or the track 425 can be longer than the tracks 420, 430. A track arrangement such as that depicted in FIG. 4 can enable a great range of club head weight and COG adjustment depending on where and how much weight is placed in the tracks 420, 425, 430.

FIGS. 5 and 6 illustrate embodiments of the present disclosure that include two perpendicular tracks. FIG. 5 illustrates an adjustable club head 500 having a sole 505. In some embodiments, the perpendicular tracks 520, 525 can be located on the sole 505. In some embodiments, the track 520 can be parallel to and located proximate a ball striking face 510 of the club head 500. In some embodiments, track 525 can join track 520, however in other embodiments track 525 does not cross or join track 520. FIG. 6 illustrates another adjustable club head 600 having a sole 605. Similar to the club head 500, the perpendicular tracks 620, 625 can be located on the sole 605. In some embodiments, the tracks 620, 625 can cross in a middle area of the sole 605. In such an arrangement, the tracks 620, 625 can be open at multiple ends, or they could be open at only one end. If they are open at only one end, for example, the weights can be moved to the center and then moved to the perpendicular track. Alternatively, embodiments having multiple open ends may be easier to manufacture, and enable the weights to be used without being designed to slide from one track to a perpendicular track.

While several possible embodiments are disclosed above, embodiments of the present invention are not so limited. For instance, while several possible configurations have been disclosed (e.g., embodiments with a plurality tracks in various arrangements), other suitable track configurations and weights could be selected without departing from the spirit of embodiments of the invention. In addition, the location and configuration used for various features of embodiments of the present invention can be varied according to a particular golf club that requires a slight variation due to, for example, the size or construction of the golf club, the user, or cost issues. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. An adjustable golf club comprising:
a club head having a sole and a ball-striking face;
two or more straight tracks located on the sole;
one or more weights;
wherein each track is configured to adjustably receive at least one of the one or more weights therealong; and
wherein the at least one weight enters the track in a direction parallel to the track and engages an inner surface of the track;
wherein the two or more straight tracks include an elongated central track, the elongated central track comprising:
a first, front position for retaining at least one of the one or more weights; and a second, rear most position for retaining the at least one weight;
wherein the elongated central track is configured to retain the at least one weight in any discrete position between the first position and the second position;
a first short track disposed on a first side of the elongated central track;
a second short track disposed on the second side of the elongated central track; and wherein the first and second short tracks are evenly spaced on either side of the elongated central track.

2. The adjustable golf club of claim 1, wherein the two short tracks are configured to accept and retain a weight in only one position.

3. The adjustable golf club of claim 1, wherein the weights are retained in place by a spring loaded detent.

4. The adjustable golf club of claim 1, wherein the weights are retained by a set screw.

5. The adjustable golf club of claim 1, wherein the elongated central track is substantially parallel to the first and second short tracks.

6. An adjustable golf club comprising:
a club head having a sole and a ball-striking face;
two or more straight tracks located on the sole;
wherein the two or more straight tracks comprise an elongated central track comprising a plurality of discrete, predetermined weight locations for adjusting the spin characteristics of the golf club;
one or more weights;
wherein at least the elongated central track is configured to adjustably receive at least one of the one or more weights therealong in at least one of the plurality of discrete, predetermined weight locations;
wherein the at least one weight enters the elongated central track in a direction parallel to the track and engages an inner surface of the elongated central track; and wherein the two or more tracks comprise two perpendicular tracks.

7. The adjustable golf club of claim 6, wherein the two perpendicular tracks cross on the sole.

8. The adjustable golf club of claim 6, wherein the two perpendicular tracks comprise one track parallel to and located proximate the ball-striking face.

9. The adjustable golf club of claim 7, wherein the at least one weight comprises a retention device configured to allow the at least one weight to be secured along the elongated central track.

10. The adjustable golf club of claim 9, wherein the retention device comprises one of a spring loaded detent and a set screw.

11. An adjustable golf club comprising:
a club head having a sole and a ball-striking face;
two or more straight tracks located on the sole;
one or more weights;
wherein each track is configured to adjustably receive at least one of the one or more weights therealong; and
wherein the at least one weight enters the track in a direction parallel to the track and engages an inner surface of the track;
wherein the two or more tracks comprise an elongated central track further comprising a plurality of markings to accurately delineate the position of the at least one weight in the elongated central track;
wherein the two or more tracks comprise three parallel tracks.

12. An adjustable golf club comprising:
a club head having a sole and a ball-striking face;
two or more straight tracks located on the sole, each of the two or more straight tracks comprising an open end and having a substantially trapezoidal cross-section; one or more weights;
wherein each track is configured to adjustably receive one or more of the one or more weights therealong, wherein the one or more weights enter the track through the open end by being slid into the track in a direction parallel to the straight track; and wherein the one or more weights are retained in place by a detent mechanism that engages an inner surface of the track;

wherein at least one of the two or more straight tracks is configured to retain at least one of the one or more weights in a first front position, a second rear position, or any discrete position along the straight track between the first position and the second position.

13. The adjustable golf club of claim 12, wherein at least one of the two or more straight tracks is configured to receive two or more weights.

* * * * *